US011315442B2

(12) United States Patent
Kammerer

(10) Patent No.: US 11,315,442 B2
(45) Date of Patent: Apr. 26, 2022

(54) UNIVERSAL LABEL

(71) Applicant: AESCULAP AG, Tuttlingen (DE)

(72) Inventor: Selina Kammerer, Dauchingen (DE)

(73) Assignee: AESCULAP AG, Tuttlingen (DE)

( * ) Notice: Subject to any disclaimer, the term of this patent is extended or adjusted under 35 U.S.C. 154(b) by 15 days.

(21) Appl. No.: 16/762,230

(22) PCT Filed: Nov. 5, 2018

(86) PCT No.: PCT/EP2018/080192
§ 371 (c)(1),
(2) Date: May 7, 2020

(87) PCT Pub. No.: WO2019/091921
PCT Pub. Date: May 16, 2019

(65) Prior Publication Data

US 2020/0365060 A1 Nov. 19, 2020

(30) Foreign Application Priority Data

Nov. 8, 2017 (DE) ..... 10 2017 126 131.1

(51) Int. Cl.
*G09F 3/10* (2006.01)
*G09F 3/02* (2006.01)

(52) U.S. Cl.
CPC ..... *G09F 3/0288* (2013.01); *G09F 3/10* (2013.01); *G09F 2003/0216* (2013.01); *G09F 2003/0239* (2013.01); *G09F 2003/0241* (2013.01); *G09F 2003/0248* (2013.01);
(Continued)

(58) Field of Classification Search
CPC ..... C09J 2301/124; C09J 2301/1242; G09F 3/0288; G09F 3/10; G09F 2003/0216; G09F 2003/0239; G09F 2003/0241; G09F 2003/0248; G09F 2003/0257;
(Continued)

(56) References Cited

U.S. PATENT DOCUMENTS 5,035,518 A * 7/1991 McClintock ..... B65D 5/708 383/70
6,021,942 A 2/2000 Monico
(Continued)

FOREIGN PATENT DOCUMENTS

CN 1169568 A 1/1998
CN 101616803 A 12/2009
(Continued)

OTHER PUBLICATIONS

German Search Report, Application No. 10 2017 126 131.1, dated May 22, 2018, 15 pages.
(Continued)

*Primary Examiner* — Cassandra Davis
(74) *Attorney, Agent, or Firm* — Culhane Meadows PLLC; Christopher A. Rothe

(57) ABSTRACT

A sandwich-type, steam-sterilizable universal label for sterile products packaging can be used both on soft packaging and hard packaging. The universal label has different adhesives with different adhesive properties which are covered in such a way that they can be exposed selectively individually and separately from each other for their respective adhesive actions.

17 Claims, 5 Drawing Sheets

(52) U.S. Cl.
CPC ..... *G09F 2003/0257* (2013.01); *G09F 2003/0269* (2013.01); *G09F 2003/0272* (2013.01)

(58) Field of Classification Search
CPC ..... G09F 2003/0269; G09F 2003/0272; G09F 3/00; G09F 2003/0245; G09F 3/02
USPC ..... 428/41.8, 41.7, 343–356
See application file for complete search history.

(56) References Cited

U.S. PATENT DOCUMENTS

| | | | | |
|---|---|---|---|---|
| 6,168,829 | B1 * | 1/2001 | Russ | C09J 7/20 427/208.4 |
| 6,281,795 | B1 * | 8/2001 | Smith | G06K 19/0776 156/249 |
| 7,165,888 | B2 * | 1/2007 | Rodick | B65D 33/1691 383/211 |
| 8,371,354 | B2 | 2/2013 | Phillips | |
| 8,763,890 | B2 | 7/2014 | Clark et al. | |
| 9,789,218 | B2 | 10/2017 | Motz et al. | |
| 10,059,499 | B2 | 8/2018 | Roesler et al. | |
| 2004/0134595 | A1 | 7/2004 | Bannert | |
| 2005/0058799 | A1 | 3/2005 | Bannert | |
| 2011/0253576 | A1 | 10/2011 | Pagones | |
| 2012/0148782 | A1 | 6/2012 | Watanabe | |
| 2016/0016165 | A1 | 1/2016 | Provencher et al. | |
| 2017/0225861 | A1 | 8/2017 | Roesler et al. | |

FOREIGN PATENT DOCUMENTS

| | | | |
|---|---|---|---|
| CN | 102918128 | A | 2/2013 |
| CN | 105163767 | A | 12/2015 |
| CN | 106035198 | A | 10/2016 |
| CN | 107067954 | A | 8/2017 |
| DE | 3529455 | A1 | 3/1986 |
| DE | 29513614 | U1 | 10/1995 |
| DE | 19809318 | C1 | 5/1999 |
| DE | 10114104 | B | 3/2005 |
| DE | 102016001276 | A1 | 8/2017 |
| JP | 4461196 | B1 | 5/2010 |
| WO | 2013142834 | A2 | 9/2013 |

OTHER PUBLICATIONS

Written Opinion of the International Searching Authority, Application No. PCT/EP2018/080192, dated Feb. 13, 2019, 20 pages.
Office Action received in Chinese Application No. 201880072531.8 dated Aug. 24, 2021, with translation, 28 pages.
Office Action received in Chinese Application No. 201880072531.8 dated Jan. 30, 2022, with translation, 17 pages.

* cited by examiner

UNIVERSAL LABEL

CROSS REFERENCE TO RELATED APPLICATIONS

This application is the United States national phase entry of International Application No. PCT/EP2018/080192, filed Nov. 5, 2018, which claims the benefit of priority of German Application No. 10 2017 126 131.1, filed Nov. 8, 2017. The contents of International Application No. PCT/EP2018/080192 and German Application No. 10 2017 126 131.1 are incorporated by reference herein in their entireties.

FIELD

The invention relates to a steam-sterilizable universal label, preferably of the sandwich-type, for sterile products packaging, which is provided and adapted to be used both on soft packaging and hard packaging. The universal label has different adhesives with different adhesive properties which are covered in such a way that they can be exposed selectively individually and separately from each other for their respective adhesive actions.

BACKGROUND

On production labels, information is printed, for instance about the filter available in the sterile packaging and/or about the production process (e.g. thermal transfer printing). As a rule, a process indicator which is to evidence that the sterile products packaging was sterilized is also available on the label. Production labels with a printed indicator serving for evidence of sterilization are state of the art. Production labels are either designed as labels with one or with two adhesive faces (double labels). The upper layer of the double label serves to enable the adhering in a patient's file.

To date, production labels for steam-sterilizable sterile products packing are generally adhered to soft packaging. In the case of hard packaging, such as sterile containers, however, the production labels are often inserted in a slide-in device externally of the sterile container. The paper and/or the film for protection of the adhesive back of the label remains on the adhesive layer, i.e. the label is not adhered to the surface of the sterile container, but inserted into the pertinent slide-in device along with a covering film on the adhesive back.

DE 198 09 318 C1 discloses a sterilization evidence label for evidencing that a sterilization was carried out. Therein, a carrier layer is provided on a first surface with an adhesive and on a second side opposite to the first surface with an evidence layer which irreversibly changes color in the event of sterilization treatment.

DE 101 14 104 A1 discloses a double label, a manufacturing method, and a device for manufacturing same. In the method for the manufacturing of double labels two labels of different size are adhered to one another at their sides facing each other. The two labels are dimensioned such that, with the known double label, the one label projects over the other label with a free portion of the adhesive face thereof.

For marking sterile products packaging such as hard packaging (e.g. sterile containers) and soft packaging (e.g. sterile bags) with the same type of label, however, a fastening device (front plate) on the hard packing is always required. This is because the previous solutions of adhesive labels can be adhered either to soft packaging only or to hard packaging only. A label for hard packaging which can be removed without residue and which can be used for any kind of sterile products packaging, including soft packaging, does not exist. So far, two different labels, and hence also two thermal transfer printers and/or a change of the label material are required.

SUMMARY

It is therefore an object of the invention to provide a label for marking the content of a packaging which is adapted to be further used for permanent documentation in the patient's file after the sterilization. After the sterilization, the uppermost layer of the label should be removed and used for documentation. The label should be adherable both to soft packaging and to hard packaging. The label should be removable without residue from hard packaging.

The gist of the invention consists in providing a universal label for marking both hard and soft sterile products packaging with an information-carrying and an adhesive-carrying section or region. An adhesive-carrying section or region comprises at least two adhesive faces or sides with different adhesives of different adhesive properties which are covered in such a way that they can be exposed selectively individually and separately from each other for their respective adhesive actions. In other words, the universal label/production label/label/sandwich label for marking sterile products packaging comprises on the lower side/the label lower side (lower label region) at least two different adhesives and/or adhesive faces, with a covering film on the label lower side.

The universal label may also be referred to as a label/production label/sandwich label. The marking of the information-carrying section or region may take place in any known marking manner, preferably by means of thermal transfer printing. The information-carrying and the adhesive-carrying section or region means the upper side of the universal label (the side of the label facing away from the sterile packaging) and a respectively exposed lower side of the universal label (the side of the label facing the sterile packaging), irrespective of the number of layers or the like. An exposed lower side means the lower side of the universal label without a covering film. Individually exposable means that the at least two adhesive faces/sides with different adhesives can selectively be exposed in that the covering film is selectively and/or partially removed and exposes the selected adhesive face. Thus, the at least two adhesive faces may be exposed in any combination also one after the other. This means that, in the case of a plurality of adhesive faces, each adhesive face may be selected and exposed individually and separately from any other one.

In other words, the gist of the invention is to two- or three-dimensionally divide the adhesive-carrying section or region/adhesive side of the label into the at least two adhesive faces and to coat the same with different glues/adhesives which have different glue/adhesive properties. Thus, the one (first) glue/adhesive is adapted to adhere to a soft packaging and the at least one further (second) glue/adhesive is adapted to adhere and residue-freely remove the label to and from a hard packaging.

The adhesive faces may be arranged two-dimensionally side by side on an adhesive-carrying region. Moreover, the covering film/protective film removably covering the adhesive faces may comprise a perforation corresponding to the size of the adhesive faces, which makes it possible to expose the individual regions separately and independently from each other. In a preferred embodiment a label for marking sterile products packaging accordingly comprises on its label lower side at least two different adhesives and/or adhesive faces/regions of two different adhesives, with a protective/covering film adapted to adhere temporarily to the label lower side, i.e. capable of being removed without any adhesive residue.

The label may be understood to be an information plate/sign/front plate on or at a sterile products packaging/packaging/hard packaging/soft packaging. The lower side of the label, i.e. the label lower side, is the side on which the label comprises at least one (film-covered) adhesive face, i.e. the entire side/face which faces the sterile products packaging and/or by which the label is fastened/adhered to a sterile products packaging. The lower side/the adhesive-carrying region may be formed of a plurality of layers, wherein one layer is adhered onto another one and partially covers the adhesive face thereof, and thus a three-dimensional structure is formed. In accordance with the invention different adhesives are classified into permanent adhesives and removable adhesives. A permanent adhesive is an adhesive with high adhesive force. A removable adhesive is an adhesive with less adhesive force than the permanent adhesive has. Sterile products packaging is packaging for sterile products adapted and provided for the use in an autoclave. Sterile products packaging may be soft packaging and/or hard packaging. A covering film/cover paper/carrier film is a film/layer of thin plastic material which is applied on an adhesive face and is easy to remove therefrom, thus exposing the adhesive face.

The different adhesive faces or sides can be exposed one after the other for their respective adhesive actions. In other words, the adhesive faces of the universal label may be exposed and remain covered individually, so that the universal label, after the separation from the sterile packaging and/or a part of the label, still comprises a functionable adhesive face by means of which the label may, for instance, be adhered to a patient's file.

In one embodiment the label comprises an upper material (upper/outer layer) having a first adhesive applied on the direct lower side thereof, and a first intermediate carrier (first intermediate layer) having a second adhesive applied on the direct lower side thereof, wherein he upper side of the intermediate carrier is adhered to the first adhesive. Preferably, the respective adhesives are applied over the entire faces of the two lower sides. It is particularly preferred that the first adhesive on the lower side of the upper material is a permanent adhesive. It is particularly preferred that the second adhesive on the lower side of the intermediate carrier is a removable adhesive. In other words, the label comprises the upper material, i.e. a first film/layer whose upper side is provided and adapted to be written on and forms the information-carrying region or section. A first adhesive forming a first adhesive face, wherein the first adhesive is preferably permanent, is applied on the direct lower side of the upper material. On the first adhesive face the first intermediate carrier, i.e. a further film/layer, adheres to the upper side thereof. The second adhesive forming a second adhesive face, wherein the second adhesive is preferably removable, is applied on the lower side of the first intermediate carrier. The permanent adhesive is an adhesive of high adhesion, at least higher adhesion than the second adhesive which is preferably removable. A removable adhesive is an adhesive with less adhesion than the permanent adhesive and may be removed without residue from a surface by manual action of force (pulling off). It is also possible to use a matched, removable adhesive as the first adhesive, which means an adhesive that can be removed without residue by means of particular solvents or temperatures. The covering film which covers the adhesive faces adheres preferably flush to the adhesive faces on the lower sides which altogether form the adhesive-carrying section or region. The afore-mentioned layered structure may also be referred to as sandwich structure/sandwich construction and the label may be referred to as sandwich label.

In a preferred embodiment the first intermediate carrier adheres to the first adhesive of the upper material. Although the first adhesive is a permanent adhesive, the connection between the first intermediate carrier and the first adhesive face which is formed by the first adhesive is designed such that the upper material and/or the permanent adhesive on the lower side thereof is easy to be removed from the first intermediate carrier, preferably by manual action of force. In other words, the upper material may be pulled off/removed from the rest and hence the newly formed label may be used for documentation, for instance.

The covering film adheres to the second adhesive of the first intermediate carrier and/or to the first adhesive of the upper material. Here, too, the connection is similar to the connection between the first intermediate carrier and the upper material and/or the first adhesive face thereof and can be removed and/or separated easily. Preferably, the first intermediate carrier has a smaller adhesive face than the upper material. In other words, the smaller first intermediate layer is adhered to the larger upper material, so that the upper material projects at the edges over the intermediate layer. The single covering film is thus in contact with the adhesive face of the first adhesive on the upper material and the second adhesive face of the second adhesive of the first intermediate carrier. The covering film is easy to remove from both, preferably by manual action of force, without damaging the adhesive faces. The pulling off of the covering film exposes the first adhesive face and the second adhesive face. By means of an appropriately perforated covering film it is also possible to expose the adhesive faces individually. Thus, the order of the layers from the upper side to the lower side is as follows in this embodiment: upper material, first adhesive, first intermediate carrier, second adhesive, covering film. The upper material, the intermediate layer and/or the covering film are preferably made of a plastic material which is suited for thermal printing.

Again in other words, the sandwich label consists of two labels (also plastic films/plastic layers/plastic coatings) which may differ in size (alternatively also only in length). Each label preferably has a different adhesive on the lower side thereof. The lowermost label (of the intermediate carrier) is the smaller, shorter label on which preferably the removable adhesive is applied. The uppermost label (upper material) projects preferably at the left and at the right symmetrically beyond the edge of the lower label and comprises in a particularly preferred manner the permanently adhering adhesive. The covering film protects the adhesive back of the entire label lower side, i.e. of the lowermost label layer. The covering film is preferably further perforated, so that only parts of the adhesive face may be exposed. When the covering film is removed completely, e.g. by pulling off, an adhesive face may result which comprises partially different adhesives. For instance, a permanent adhesive face/adhesive layer may be available at the left and at the right at the sides of the label and in the middle a region with a removable adhesive.

In a further preferred embodiment the label may comprise a second intermediate carrier between the upper material and the first intermediate carrier, which adheres to the first adhesive of the upper material and which comprises a third adhesive and/or adhesive face to which the first intermediate carrier adheres. In other words, a second intermediate carrier is introduced between the upper material and/or its first adhesive face and the first intermediate carrier and/or its upper side. The structure of the second intermediate carrier resembles that of the first intermediate carrier. Alternatively, the second intermediate carrier may, instead of a permanent adhesive, comprise a removable adhesive in order that the upper material is even easier to remove from the first intermediate carrier. This means that the upper material firmly adheres to the second intermediate layer which may be removed more easily from the first intermediate carrier since the adhesive for the connection between the second and the first intermediate carriers is to remove more easily than a permanent adhesive. Thus, the order of the layers from the upper side to the lower side is as follows in this embodiment: upper material, first adhesive, second intermediate carrier, third adhesive, first intermediate carrier, second adhesive, covering film.

The first intermediate carrier comprises preferably less face and/or adhesive face than the upper material to which the intermediate carrier adheres directly or indirectly. Directly means here that the first intermediate carrier directly contacts the adhesive face of the upper material, and indirectly means that the first intermediate carrier contacts at least one further intermediate carrier which is arranged between the first intermediate carrier and the upper material. Preferably, all intermediate carriers are smaller, i.e. have a smaller contact face/adhesive face than the upper material, wherein the adhesive is, both on the upper material and on the intermediate carriers, preferably applied over the entire face, i.e. on the entire lower side in each case.

In a further preferred embodiment the label comprises an upper material whose lower side comprises at least two different adhesives (on two different regions of the one lower side) which are covered by a covering film, wherein the at least two adhesives are preferably applied directly on the lower side of the upper material. In other words, the (first) intermediate carrier is omitted in this embodiment, in contrast to the first embodiment. Due to the fact that at least two different adhesive are applied on the lower side of the upper material on two spaced apart/separated regions of this one lower side, a decision may be made as to which of both is to be used. This is accomplished by a perforated covering film.

A perforated/punched-in covering film may be used in all embodiments. A perforation is a provision of holes or a reduction of material at particular, desired positions/lines which causes a predetermined breaking point in the covering film, so that covering film segments may partially be removed in all embodiments. The partial removal of the covering film makes it possible to selectively expose the first adhesive and/or the second adhesive. In other words, the perforation is suited and adapted to divide the covering film into segments that may be removed individually from the lower side, i.e. the preferably different adhesive faces. It is irrelevant whether the adhesive faces are formed on one single surface (only on the upper material) or on a plurality (on the upper material and the intermediate carrier) as long as the lower side of the label (label lower side) which forms the contact face is fully covered by the covering film. The label is provided with the covering film during transport so as to offer protection from inadvertent gluing. In use, i.e. when applying the label, the covering film is removed.

In a preferred embodiment the adhesives each form an adhesive face meshing in a comb-like manner. In other words, one adhesive face formed by the first adhesive meshes like a comb with a second adhesive face formed by the second adhesive. Both adhesives may be on one level, i.e. one layer, such as, for instance, the lower side of the upper material. However, a design in which the intermediate carrier forms a comb shape and adheres to the lower side of the upper material, which in turn forms an adhesive face on the complete lower side, is also conceivable. In analogy to this, of course, the covering film is shaped, i.e. divided into two segments. Preferably, at the comb grip defined by the comb shape the covering film is gripped and removed in the direction of the teeth/prongs. In this process the covering film will separate due to the perforation/punching and the other segment will remain on the lower side of the label or may be pulled off alternatively or additionally. Alternatively, the adhesives may form an adhesive face in which one adhesive is completely enclosed by the at least one further adhesive, preferably completely. In other words, one adhesive is surrounded by the other adhesive like an island.

Alternatively, the upper material may comprise a smaller face and/or upper side than the intermediate carrier, and both adhesives may, with an equal structure, each be applied on both sides on the intermediate carrier. In other words, both adhesives are directly applied on the intermediate carrier in an alternative embodiment.

The present invention thus enables to mark sterile containers and soft packaging by the direct adhering of a label. For the direct marking of sterile containers and soft packaging only one label material and hence only one printer (e.g. a thermal transfer printer, ink jet printer, or laser printer) is required. The label is retained securely on the hard packaging. It is no longer possible for the label to fall out of the slide-in device of hard packaging during sterilization.

BRIEF DESCRIPTION OF THE DRAWING FIGURES

DETAILED DESCRIPTION

Figure 1:
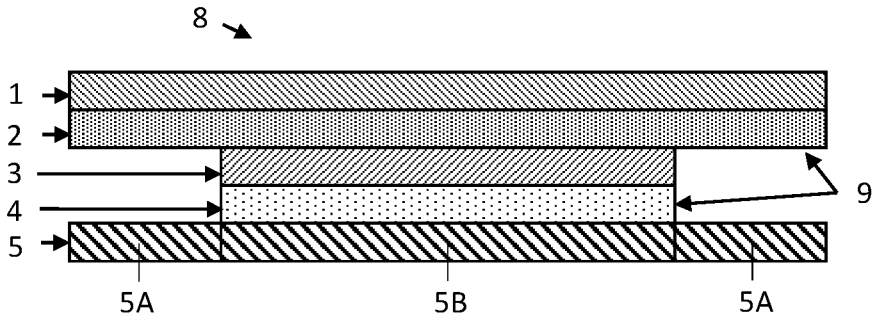
FIG. 1 shows a first preferred embodiment in a lateral sectional view.

FIG. 1 illustrates a first preferred embodiment in a lateral sectional view. One side of an upper material 1 forms an upper side/information-carrying region or section 8 of a label which is provided and adapted to be printed, preferably printed with a thermal transfer printer.

On the lower side of the upper material 1 a first adhesive is applied which forms a first adhesive face 2 to which a first intermediate carrier 3 adheres directly and covers the first adhesive layer 2 partially (centrally). The upper material 1 comprises a rectangular face diametrically opposed to the upper side/the information-carrying region or section 8. The adhesive face 2 is applied over the entire face of the upper side/the information-carrying region or section 8. The adhesive face 2 consists of a first adhesive, a permanent adhesive which is suited and adapted to adhere to a sterile soft packaging.

The first intermediate carrier 3 is of smaller face than the upper material 1, so that the face of the upper material 1 and/or its adhesive face 2 projects beyond the circumferential edge of the first intermediate carrier 3 at two sides at least. The first intermediate carrier 3 is also rectangular, wherein the long sides of the first rectangular intermediate carrier 3 are flush with the long sides of the upper material 1. Since the first intermediate carrier 3 is arranged centrally and has a smaller side length of the long sides, i.e. is shorter, the upper material 1 and/or its adhesive face 2 projects at both (short) sides uniformly beyond the intermediate carrier. A second adhesive which forms a second adhesive face 4 is in turn applied on the intermediate carrier 3. The second adhesive is a removable adhesive which is provided and adapted to adhere to a sterile hard packaging.

On both exposed adhesive faces 2 and 4 which form the adhesive-carrying region or section 9, a covering film 5 adheres directly. The covering film is perforated and divided into the covering film segments 5A and 5B, wherein the segment 5B is an interior segment and is lined at diametrically opposed sides by two further segments 5A. In this embodiment, the covering film segments 5A adhere to the adhesive face 2 of the upper material 1, which corresponds to the section of the upper material 1 which projects beyond the intermediate carrier 3, and the covering film segment 5B to the adhesive face 4 of the intermediate carrier 3. The perforation of the covering film 5 between the covering film segments 5A and 5B is designed as a line, preferably by pressing or punching.

The universal label is formed from its upper side/information-carrying region or section 8 to its lower side/adhesive-carrying region or section 9 by the upper material 1, the adhesive face 2, the intermediate carrier 3 and the adhesive face 3 and is covered on its lower side/the adhesive-carrying region or section 9 by the covering film 5. All the elements mentioned in the foregoing list are placed directly and immediately contiguous to the one positioned before. In FIG. 1 the layer thicknesses are not illustrated to scale, in reality the lower side/the adhesive-carrying region or section 9 is substantially plane.

Figure 1A:
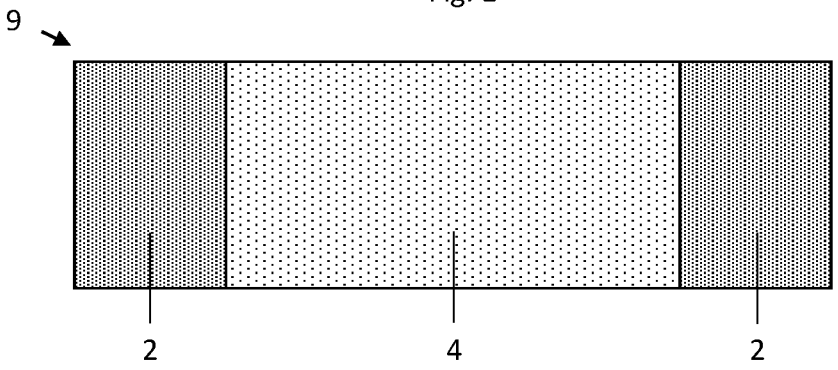
FIG. 1A shows the lower side of the first embodiment of FIG. 1 without covering film.

In FIG. 1A the lower side/the adhesive-carrying region or section 9 of the first embodiment of FIG. 1 is illustrated without covering film. Thus, a rectangular adhesive face is illustrated which consists of the adhesive faces 2 and 4 and which is adhered to a sterile products packaging and consists of two different adhesives and thus of two different adhesive faces, the adhesive face 4 and the adhesive face 2. The adhesive faces 2 and 4 together form, in analogy to their respective carrier substrates, i.e. the upper material 1 and the first intermediate carrier 3, a rectangle. Since the first rectangular intermediate carrier 3 is positioned on the longer upper material 1 and both have the dame breadth, a structure results in which the adhesive face 4 is arranged in the middle and the adhesive face 2 symmetrically projects beyond it at the right and at the left.

Figure 1B:
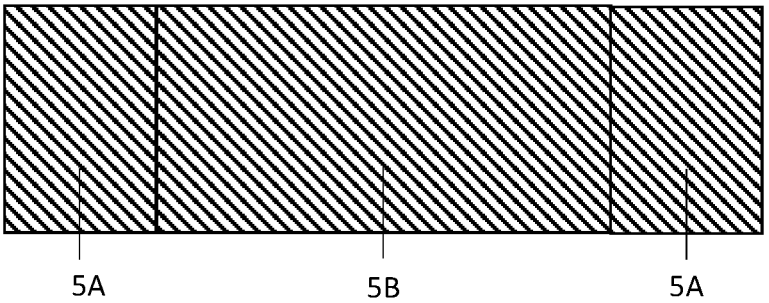
FIG. 1B shows the lower side of the first embodiment of FIG. 1 with covering film.

FIG. 1B shows the lower side 9 of the first embodiment of FIG. 1 with the covering film 5. The structure and/or the arrangement is analogous to the layout of the adhesive faces 2 and 4. The covering film 5 is divided into the covering film segments 5A which adhere to the corresponding two adhesive faces 2, and the covering film segment 5B which adheres to the corresponding adhesive face 4.

Figure 2:
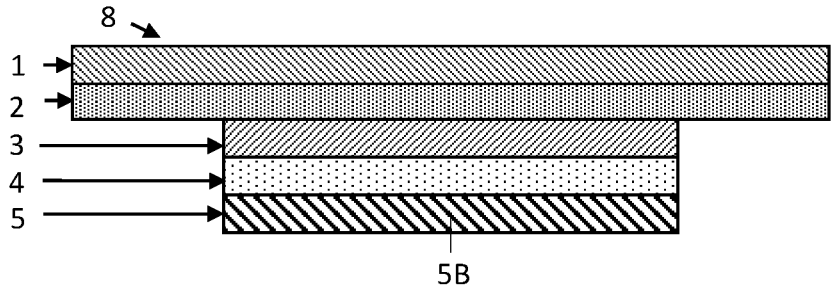
FIG. 2 shows a sectional view of the first embodiment with the exterior covering film removed.

FIG. 2 shows a sectional view of the first embodiment in which the exterior covering film segments 5A which are formed at the two diametrically opposed sides of the covering film segment 5B were removed. In other words, the covering film segments 5A were removed from the adhesive faces 2. Thus, the permanent adhesive faces 2 are exposed and the label is provided and adapted for adhering to a soft packaging for sterilization. Hence, the contact face of the label with the sterile soft packaging is formed by the two adhesive faces 2 and the covering film segment 5B.

Alternatively, with this use of the first embodiment the covering film segment 5B may additionally also be removed since the adhesive face 4, which then forms the contact face together with the adhesive faces 2, has less adhesive force.

The adhesive faces 2 with the permanent adhesive are provided for the use on soft packaging. In this case the covering film segment 5A or the entire covering film 5 is removed. The process of adhering the label to a soft packaging comprises the steps of: Removing the covering film segments 5A. Adhering the label to the soft packaging (by means of the permanent adhesive faces 2). Steam-sterilization of the soft packaging. Removing the label from the soft packaging. Separating the upper material 1 from the first intermediate carrier 3. Adhering or sorting the so-formed label (upper material) to or in the patient's file.

Figure 2A:
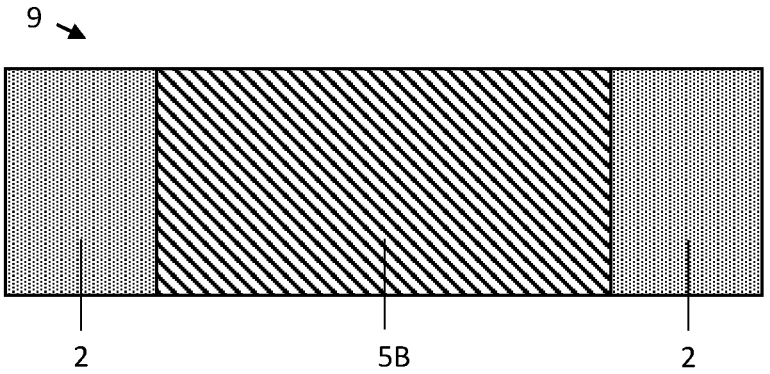
FIG. 2A shows the lower side of FIG. 2.

FIG. 2A shows the lower side of FIG. 2, wherein it is clearly recognizable that the adhesive faces 2 which are formed with permanent adhesive form the contact face for a soft packaging, together with the covering film segment 5B which rests on the removable adhesive.

Figure 3:
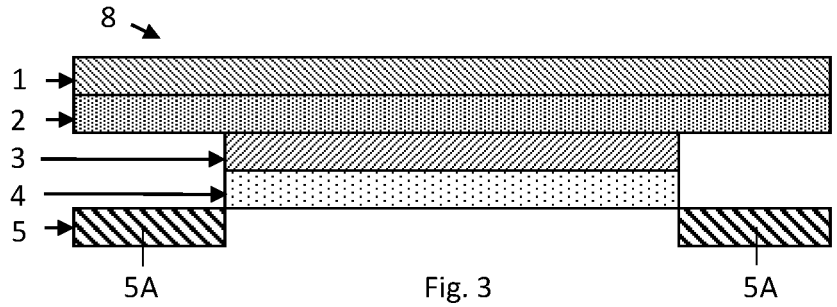
FIG. 3 shows a sectional view of the first embodiment with the interior covering film removed.

FIG. 3 shows a sectional view of the first embodiment in which the interior covering film 5B was removed. In other words, only the covering film segment 5B was removed from the adhesive face 4 and the film segments 5A remain on both sides on the two adhesive faces 2. Thus, the removable adhesive face 4 is exposed and the label is provided and adapted for adhering to a hard packaging for sterilization. The covering film 5A remains on the sections with the permanent adhesive. If they were also exposed, adhesive residues would be left on the hard sterile products packaging later during the removing of the label (after the sterilization and the use of the packaging content). A positive effect with the remaining covering film segments 5A is that they may be used as a gripping region to facilitate the removal of the label from the hard packaging.

The process of adhering the label to a hard packaging comprises the steps of: Removing the covering film segment 5B in the middle of the label (with the covering film segments 5B remaining on the label). Adhering the label to the hard packaging (by means of the removable adhesive). Steam-sterilization of the hard packaging. Removing the label from the hard packaging (the covering film segments 5B at the right and at the left enable easy gripping). Separating the upper material 1 from the first intermediate carrier 2. Adhering or sorting the new label (upper material) to or in the patient's file.

Figure 3A:
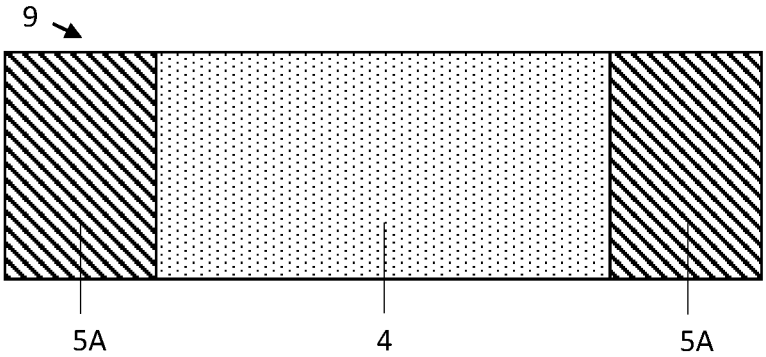
FIG. 3A shows the lower side of FIG. 3.

FIG. 3A shows the lower side 9 of FIG. 3, wherein it is illustrated clearly that the adhesive face 4 which is designed with a removable adhesive forms the contact face for a hard packaging, together with the covering film segments 5A which rest on the permanent adhesive.

Figure 4:
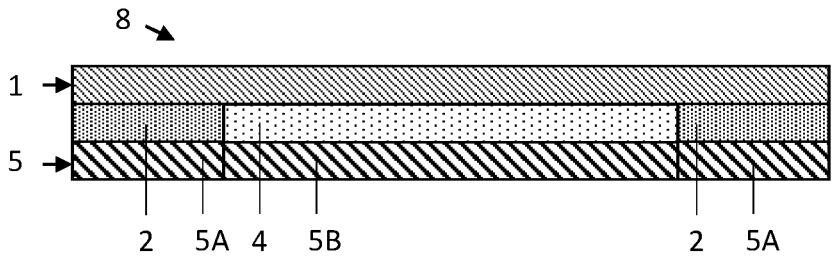
FIG. 4 shows a second embodiment in a lateral sectional view.

FIG. 4 shows a second embodiment in a lateral sectional view. The difference over the first embodiment consists in that both adhesive faces 2 and 4 are applied directly on the upper material 1 with respectively different adhesives. The upper material 1 is thus formed/coated directly with two different adhesive faces 2 and 4. This means that two different adhesives are applied directly on the upper material 1 and form the respective adhesive faces 2 and 4. On the two adhesive faces 2 and 4 again a perforated covering film 5 with two covering film segments 5A and 5B is positioned, which correspond to the respective shapes of the respective adhesive faces 2 and 4. A label in accordance with the second embodiment is formed from the upper side 8 to the lower side 9 by an upper material 1 and a face/layer formed of the two adhesive faces 2 and 4. The adhesive faces 2 and 4 which form a plane face may optionally be a permanent or a removable adhesive. Due to this embodiment labels may be used as production labels both on soft packaging and on hard packaging. A documentation in the patient's file may in this case take place, for instance, by adhering to a paper file with the hitherto unused adhesive face.

Figure 4A:
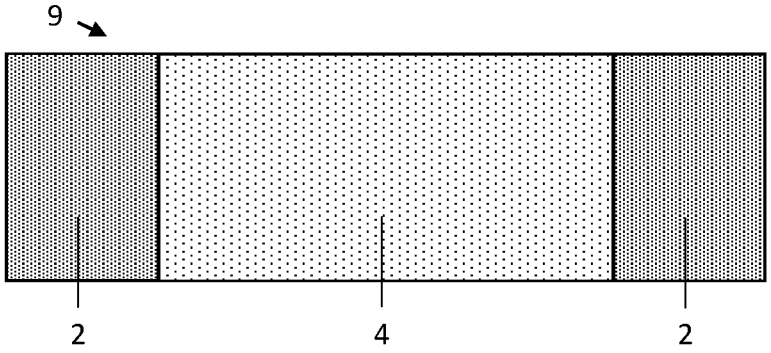
FIG. 4A shows the lower side of the second embodiment of FIG. 4 without covering film.

FIG. 4A shows the lower side of the second embodiment of FIG. 4 without covering film. The lower side of the label with covering film of the second embodiment is analogous to the first embodiment, i.e. analogous to FIG. 1A. Although in the first embodiment the adhesive is applied on two films, the lower side with the adhesive faces looks analogously.

Figure 4B:
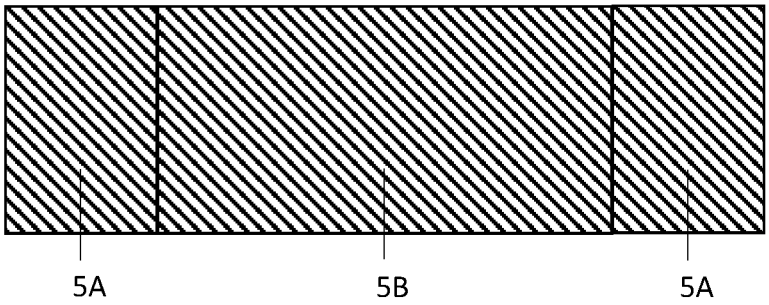
FIG. 4B shows the lower side of the second embodiment of FIG. 4 with covering film.

FIG. 4B shows the lower side of the first embodiment of FIG. 4 with covering film, as may be seen in analogy in FIG. 1B.

Figure 5:
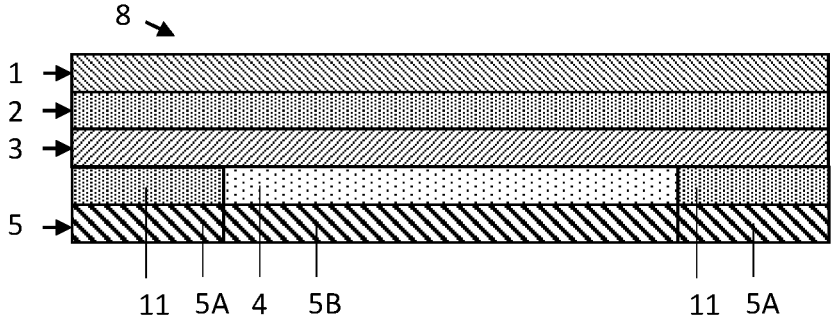
FIG. 5 shows a third embodiment in a lateral sectional view.

FIG. 5 shows a third embodiment in a lateral sectional view. In this embodiment the intermediate carrier 3 is coated directly with two different adhesive faces 11 and 4. This means that two different adhesives are applied directly on the first intermediate carrier 3 and form the respective adhesive faces 11 and 4. The third adhesive face 11 is designed such that the same distribution of the respective adhesives on the contact face results as in FIG. 1A. Furthermore, the adhesive face 11 consists preferably of the same adhesive as the adhesive face 2, particularly preferred a permanent adhesive. On the two adhesive faces 11 and 4 there is again positioned a perforated covering film 5 with two covering film segments 5A and 5B which correspond to the respective shapes of the respective adhesive faces 11 and 4. A label in accordance with the third embodiment is formed from the upper side 8 to the lower side 9 by an upper material 1, a first adhesive face 2, the intermediate carrier 3 and a face/layer formed of the two adhesive faces 11 and 4. In this embodiment the adhesive face 2 may be a permanent or else a removable adhesive since a direct contact with a sterile packaging does not exist. The adhesive faces 11 and 4 which form a plane face may optionally be permanent or removable adhesive. In this embodiment the face of the first intermediate carrier 3 corresponds to the face of the upper material 1 and adheres to the adhesive face 2 of the upper material 1. Due to this embodiment labels may be used as production labels both on soft packaging and on hard packaging. A documentation in the patient's file may in this case take place, for instance, by adhering to a paper file with the hitherto unused adhesive face. Due to this embodiment it is possible to only remove the upper material after the sterilization. This has the advantage that the adhesive faces of this label layer are still completely unused. Furthermore, damages to the label during the process of removal are thus avoided. These advantages apply for all labels comprising at least two intermediate carriers.

Figure 6:
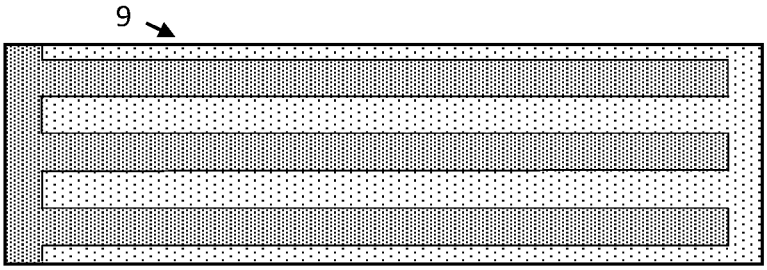
FIG. 6 shows the lower side of a fourth embodiment without covering film.
Figure 6A:
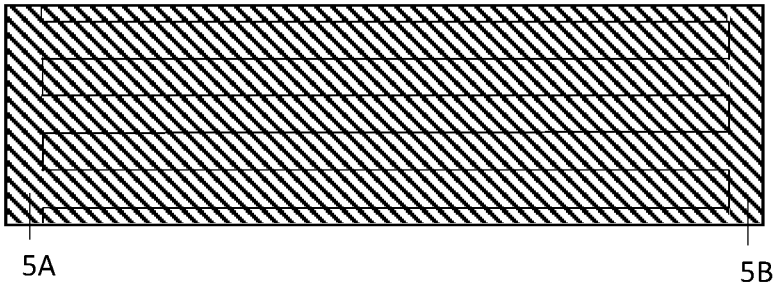
FIG. 6A shows the lower side of the fourth embodiment with covering film.

FIG. 6 shows the lower side of a fourth embodiment without covering film, and FIG. 6A shows the lower side of the fourth embodiment with covering film. In this embodiment the adhesive faces 2 and 4 are designed comb-like. This means that the adhesive faces 2 and 4 each form a rectangular comb grip having rectangular prongs project perpendicularly therefrom. The two comb-shaped adhesive faces 2 and 4 mesh at their rectangular prongs. If the label is to be adhered to hard packaging, the covering film segment 5A will have to be pulled off from the left to the right, so that the adhesive face 2 with the permanent adhesive face is exposed. If the adhesive segment 5B is pulled from the right to the left, the adhesive face 4 with the removable adhesive is exposed. It is also possible to exchange the positions of the adhesive faces 2 and 4 and their respective covering film segments 5A and 5B. This embodiment of the adhesive faces can be used directly on two-dimensional faces on an upper material 1 or at least a further intermediate carrier. Furthermore, this embodiment can be used on three-dimensional structures, i.e. on structures resembling in their construction to the first embodiment and having the adhesive faces 2 and 4 formed on different layers. In addition to the third and fourth embodiments, further constellations are also possible, such as, for instance, a narrow strip of permanent adhesive at a short side of a rectangle and a large face of removable adhesive.

Figure 7:
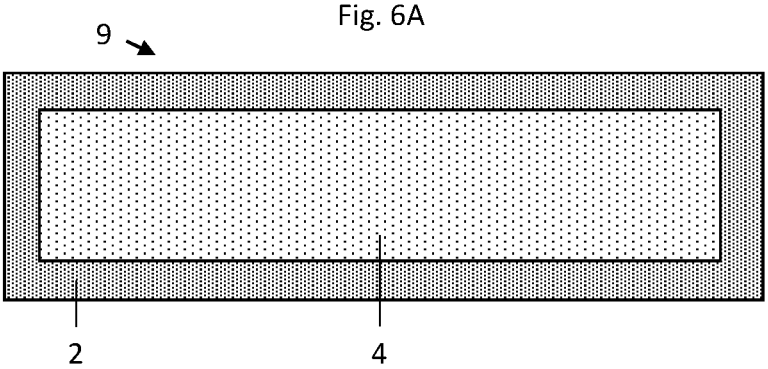
FIG. 7 shows the lower side of a fifth embodiment without covering film.
Figure 7A:
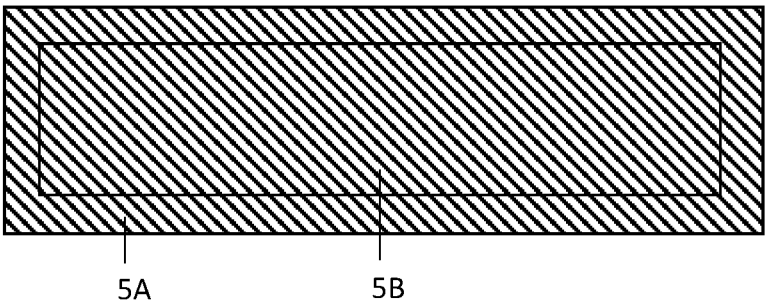
FIG. 7A shows the lower side of the fifth embodiment with covering film.

FIG. 7 shows the lower side of a fifth embodiment without covering film, and FIG. 7A shows the lower side of the fifth embodiment with covering film. In this embodiment the adhesive face 4 is a rectangle whose sides are all shorter than the sides of the rectangular adhesive face 2, wherein the adhesive face 4 is centered horizontally and vertically. It is also possible to exchange the positions of the adhesive faces 2 and 4 and their respective covering film segments 5A and 5B. This embodiment of the adhesive faces can be used directly on two-dimensional faces on an upper material 1 or at least a further intermediate carrier. Furthermore, this embodiment can be used on three-dimensional structures, i.e. on structures resembling in their construction to the first embodiment and having the adhesive faces 2 and 4 formed on different layers.

Figure 8:
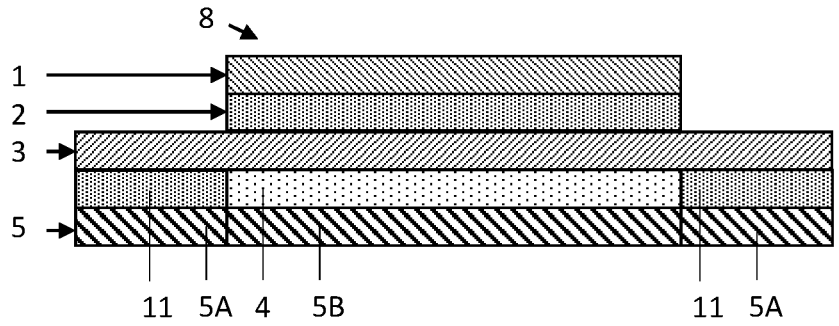
FIG. 8 shows a sixth embodiment in a lateral sectional view.

FIG. 8 shows a sixth embodiment in a lateral sectional view. The layer-like construction is like the embodiment in FIG. 5, with the exception that the upper material 1 and the first adhesive face 2 are smaller, i.e. shorter, than the first intermediate layer 3 and the covering film 5. In other words, the upper material 1 has a smaller face than the first intermediate layer 3, so that the face of the intermediate carrier 3 projects beyond the circumferential edge of the upper material 1 at two sides at least. The first intermediate carrier 3 and the upper material 1 are rectangular, wherein the long sides of the first intermediate carrier 3 are flush with the long sides of the upper material 1. Since the upper material 1 is arranged centrally and has a smaller side length, i.e. is shorter, the first intermediate carrier 3 projects at both (short) sides uniformly beyond the intermediate carrier. On the intermediate carrier 3 in turn a second adhesive is applied which forms a second adhesive face 4. The second adhesive is a removable adhesive which is provided and adapted to adhere to a sterile hard packaging.

Figure 9:
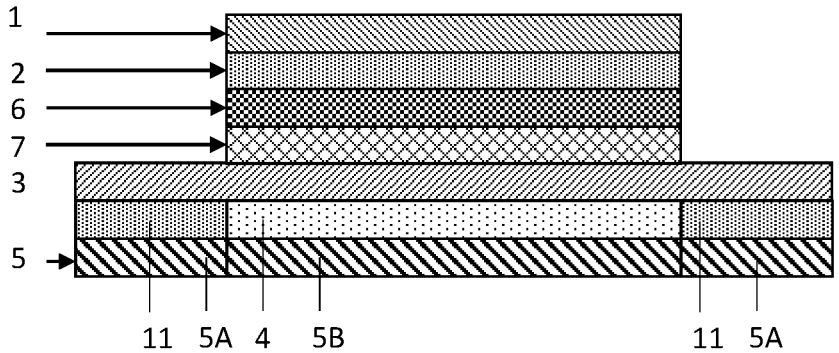
FIG. 9 shows a seventh embodiment in a lateral sectional view.

FIG. 9 shows a seventh embodiment in a lateral sectional view whose construction is like that of the sixth embodiment, with the exception that in this embodiment a second intermediate carrier 6 with a third adhesive face 7 was introduced between the first adhesive face 2 and the first intermediate carrier 3. The additionally introduced intermediate carrier 6 is to comprise the same permanent adhesive as the upper material 1, i.e. the adhesive face 7 is to be of the same material as the adhesive face 2. The geometric dimensions of the intermediate carrier 6 and of the adhesive face 7 correspond to those of the upper material 1. Alternatively, the first and/or the second intermediate carrier 3 and 6 and/or their adhesive faces 4 and 7 may be removable adhesive faces.

Figure 10:
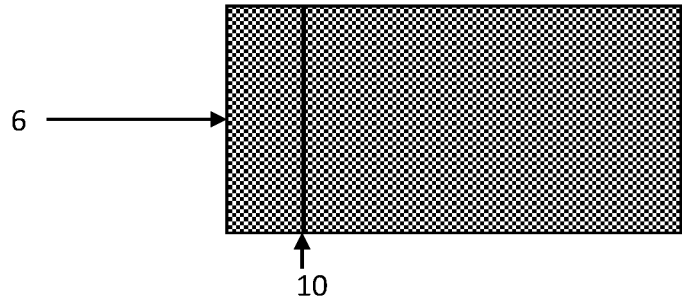
FIG. 10 shows the upper side of an eighth embodiment.

FIG. 10 shows the upper side of an eighth embodiment and/or the upper material 1 with a press-cut 10. In order to separate/detach the upper material 1 as easily as possible from at least one intermediate carrier, the press-cut 10 of the upper material 1 is punched down to at least one intermediate carrier.

The invention claimed is:

1. A universal label for marking both hard and soft sterile products packaging, comprising:

an upper material, an upper side of which forming an information-carrying section;

a first adhesive face formed by a first adhesive applied to a lower side of the upper material;

a first intermediate carrier, an upper side of which adhering to the first adhesive face;

a second adhesive face and a third adhesive face, the second adhesive face being formed by a second adhesive applied to a lower side of the first intermediate carrier, the third adhesive face being formed by a third adhesive applied to the lower side of the first intermediate carrier, wherein the second adhesive is different from the third adhesive and has different adhesive properties compared to the third adhesive, the second adhesive face and the third adhesive face being comprised in an adhesive-carrying section which forms the lower side of the universal label and which lies on the side opposite from the information-carrying section of the universal label, and a covering film are covered covering the second adhesive face and the third adhesive face in such a way on the lower side of the universal label by a covering film that they that the second adhesive face and the third adhesive face are exposable separately from each other for their respective adhesive actions.

2. The universal label according to claim 1, wherein the second adhesive face and the third adhesive face are exposable one after the other for their respective adhesive actions.

3. The universal label according to claim 1, wherein the second adhesive face and the third adhesive face are separated from each other on one adhesive plane.

4. The universal label according to claim 1, wherein the covering film adheres to the second adhesive face and to the third adhesive face.

5. The universal label according to claim 1, wherein the label comprises a second intermediate carrier between the upper material and the first intermediate carrier, said second intermediate carrier adhering to the first adhesive face and comprising a fourth adhesive to which the first intermediate carrier adheres.

6. The universal label according to claim 1, wherein the covering film has a perforated or punched in portion.

7. The universal label according to claim 6, wherein the perforated or punched in portion is suited and adapted to subdivide the covering film into segments which are individually removable from the lower side of the universal label.

8. The universal label according to claim 1, wherein the second adhesive face and the third adhesive face mesh with one another.

9. The universal label according to claim 1, wherein the first adhesive applied on the lower side of the upper material is a permanent adhesive.

10. The universal label according to claim 1, wherein the second adhesive applied on the lower side of the first intermediate carrier is a removable adhesive.

11. The universal label according to claim 8, wherein the second adhesive face and the third adhesive face each have a rectangular comb grip section and rectangular prong sections projecting perpendicularly from the rectangular comb grip section.

12. The universal label according to claim 11, wherein the rectangular prong sections of the second adhesive face and the rectangular prong sections of the third adhesive face mesh such that the second adhesive face and the third adhesive face in combination form a rectangle.

13. The universal label according to claim 1, wherein the first adhesive is a permanent or removable adhesive, the second adhesive is a removable adhesive, and the third adhesive is a permanent adhesive.

14. The universal label according to claim 13, wherein the first adhesive is a removable adhesive.

15. The universal label according to claim 1, wherein the universal label consists of the upper material, the first adhesive face, the first intermediate carrier, the second adhesive face, the third adhesive face and the covering film.

16. The universal label according to claim 1, wherein an area of the upper material corresponds to an area of the first intermediate carrier.

17. The universal label according to claim 1, wherein the second adhesive face has a rectangular shape; and the third adhesive face frames and surrounds the second adhesive face and has a rectangular shape with an inner rectangular cut-out where the second adhesive face is provided.

* * * * *